US010669793B2

(12) United States Patent
Yang et al.

(10) Patent No.: US 10,669,793 B2
(45) Date of Patent: Jun. 2, 2020

(54) DRILLABLE LATCHING PLUG

(71) Applicant: Schlumberger Technology Corporation, Houston, TX (US)

(72) Inventors: Baozhong Yang, Pearland, TX (US); Dwayne P. Terracina, Spring, TX (US); Tommy G. Ray, Spring, TX (US); Jeremy O'Neal, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 153 days.

(21) Appl. No.: 15/800,696

(22) Filed: Nov. 1, 2017

(65) Prior Publication Data

US 2018/0135370 A1 May 17, 2018

Related U.S. Application Data

(60) Provisional application No. 62/416,481, filed on Nov. 2, 2016.

(51) Int. Cl.

| | |
|---|---|
| ***E21B 23/02*** | (2006.01) |
| ***E21B 33/129*** | (2006.01) |
| ***E21B 33/12*** | (2006.01) |
| ***E21B 29/00*** | (2006.01) |
| *E21B 33/14* | (2006.01) |

(52) U.S. Cl.

CPC ..... *E21B 23/02* (2013.01); *E21B 29/00* (2013.01); *E21B 33/1204* (2013.01); *E21B 33/1293* (2013.01); *E21B 29/002* (2013.01); *E21B 33/14* (2013.01)

(58) Field of Classification Search

CPC ..... E21B 23/02; E21B 33/134

See application file for complete search history.

(56) References Cited

U.S. PATENT DOCUMENTS

| | | | | |
|---|---|---|---|---|
| 2,856,003 | A * | 10/1958 | Fredd | E21B 23/02 166/126 |
| 4,139,059 | A * | 2/1979 | Carmichael | E21B 43/10 166/208 |
| 4,436,152 | A * | 3/1984 | Fisher, Jr. | E21B 23/02 166/214 |
| 7,640,984 | B2 | 1/2010 | Vert et al. | |
| 7,909,109 | B2 | 3/2011 | Angman et al. | |
| 7,926,578 | B2 | 4/2011 | Moffitt et al. | |
| 7,926,590 | B2 | 4/2011 | Eriksen et al. | |
| 8,733,474 | B2 | 5/2014 | Nikiforuk | |
| 8,851,167 | B2 | 10/2014 | Eriksen | |
| 2004/0060700 | A1* | 4/2004 | Vert | E21B 7/20 166/291 |
| 2017/0122059 | A1* | 5/2017 | Cookston | E21B 33/04 |

OTHER PUBLICATIONS

Baker Hughes, Drillable Bridge Plugs, accessed from https://www.bakerhughes.com/products-and-services/wellbore-intervention/remedial-and-stimulation/drillable-bridge-plugs on Nov. 1, 2017, 2 pages.

* cited by examiner

*Primary Examiner* — D. Andrews

(57) ABSTRACT

A latching dog includes a dog body, at least one engagement arm protrudes from an outer radial surface of the dog body in a transverse direction, and at least one retention fin protrudes from the dog body in a longitudinal direction. The at least one retention fin maintains the latching dog engaged with a housing surface to keep the latching dog at a desired axial and/or rotational position while milling the housing and latching dog.

20 Claims, 6 Drawing Sheets

DRILLABLE LATCHING PLUG

CROSS-REFERENCE TO RELATED APPLICATIONS

This application claims the benefit of, and priority to, U.S. Patent Application No. 62/416,481, filed Nov. 2, 2016, and titled "Drillable Latching Plug," which application is incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing. A variety of drilling methods may be utilized depending partly on the characteristics of the formation through which the wellbore is drilled.

Some wellbores are reinforced with casing while drilling to stabilize the wellbore. Conventional casing is a steel or other metallic tubular that provides a durable surface for the interior of the wellbore. The casing allows downhole tools to be tripped into the wellbore with little or no damage to the integrity of the wellbore. The outer diameter of the casing is smaller than the drilled diameter of the initial wellbore, leaving an annular space around the casing and between the casing and wellbore. The annular space is filled with cement or other material that can harden and retain the casing in place relative to the wellbore. To cement the casing in place, the cement is pumped to the bottom of the casing and allowed to flow up the annular space.

To pump the cement to the bottom of the casing, a displacement fluid may be pumped behind the cement. A plug may be positioned between the displacement fluid and the cement to provide a barrier to pressure communication on either side of the plug. In drilling operations where full bore casing access is maintained during the operations, the casing may include an engagement feature, such as a plug landing nipple (PLN), on an inner surface of the casing. The plug can engage with the PLN by expandable dogs to limit prevent the longitudinal movement of the plug relative to the casing. The PLN and the plug may be positioned at or near the downhole end of the casing (or, in the case of horizontal drilling, the end of the casing farthest from the rig). After the cement cures, the plug may be milled away to allow further drilling or other operations through that portion of the wellbore.

SUMMARY

In some embodiments, a latching dog includes a dog body having a longitudinal axis. The dog body also includes an outer radial surface and at least one engagement arm protruding from the outer radial surface of the dog body in a radial direction that is transverse to the longitudinal axis. At least one retention fin protrudes from the dog body.

In one or more embodiments, a latching dog includes a dog body, at least one engagement arm, and at least one retention fin. The dog body has a longitudinal axis in a longitudinal direction and the dog body has an outer radial surface. The at least one engagement arm extends in a radial direction from the outer radial surface and has an outer wear surface at an engagement height from the outer radial surface of the dog body. The at least one retention fin protrudes from the dog body.

In some embodiments, a downhole tool includes a housing with an outer surface. The outer surface of the housing defines an opening and at least one latching dog of the downhole tool is positioned in the opening. The at least one latching dog includes a dog body having a longitudinal axis and an outer radial surface. At least one engagement arm of the at least one latching dog protrudes from the outer radial surface of the dog body in a radial direction that is transverse to the longitudinal axis. The at least one engagement arm has an outer surface extending an engagement height from the outer radial surface of the dog body. At least one retention fin of the at least one latching dog protruding from the dog body.

In one or more embodiments, a downhole tool includes a housing, at least one latching dog, and a biasing element. The housing has an outer surface with an opening therein. The latching dog is positioned at least partially in the opening of the housing and includes a dog body, at least one engagement arm, and at least one retention fin. The dog body has a longitudinal axis and the dog body has an outer radial surface. The at least one engagement arm protrudes in a radial direction from the outer radial surface and has an outer wear surface that is an engagement height from the outer radial surface of the dog body. The at least one retention fin protrudes from the dog body. The biasing element is configured to move the at least one latching dog in the radial direction.

According to some embodiments, a method of removing a downhole tool includes positioning a downhole tool in a wellbore casing. A latching dog of the downhole tool is moved toward an extended position and engages the casing with at least one engagement arm of the latching dog. The latching dog has at least one retention fin that engages a tapered end surface of a housing of the downhole tool when the at least one engagement arm is in the extended position. The downhole tool is milled and, while milling the downhole tool, at least a portion of the retention fin of the latching dog is maintained in engagement with the tapered end surface of the housing.

In some embodiments, a method of securing and removing a downhole tool includes positioning a downhole tool in a casing and moving a latching dog of the downhole tool toward an extended position to engage the casing with at least one engagement arm of the latching dog. The latching dog has at least one retention fin. The method further includes milling at least a portion of the downhole tool and at least a portion of a dog body of the latching dog. At least a portion of the retention fin remains engaged with the casing after milling at least a portion of the dog body.

This summary is provided to introduce a selection of concepts that are further described below in the detailed description. This summary is not intended to identify key or essential features of the claimed subject matter, nor is it intended to be used as an aid in limiting the scope of the claimed subject matter. Additional features of embodiments of the disclosure will be set forth in the description which follows, and in part will be apparent from the description, or may be learned by the practice of such embodiments. The features of such embodiments may be realized and obtained by means of the instruments and combinations particularly pointed out in the description and in the appended claims.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. While some of the drawings may be schematic or exaggerated representations of concepts, other drawings not described as schematic or exaggerated are drawn to scale for some embodiments, but are not to scale for other embodiments. Understanding that the drawings depict some example embodiments, the embodiments will be described and explained with additional specificity and detail through the use of the accompanying drawings in which.

DETAILED DESCRIPTION

Some embodiments of the present disclosure generally relate to devices, systems, and methods for securing and removing a downhole tool. More particularly, some embodiments of the present disclosure relates to devices, systems, and methods for engaging a casing wall or feature in a casing wall with one or more latching dogs of a downhole tool. In some embodiments, the downhole tool, the one or more latching dogs, or both may be milled and cuttings flushed uphole or otherwise removed. The latching dogs may include one or more features to allow for more reliable milling or removal of the cuttings.

Figure 1:
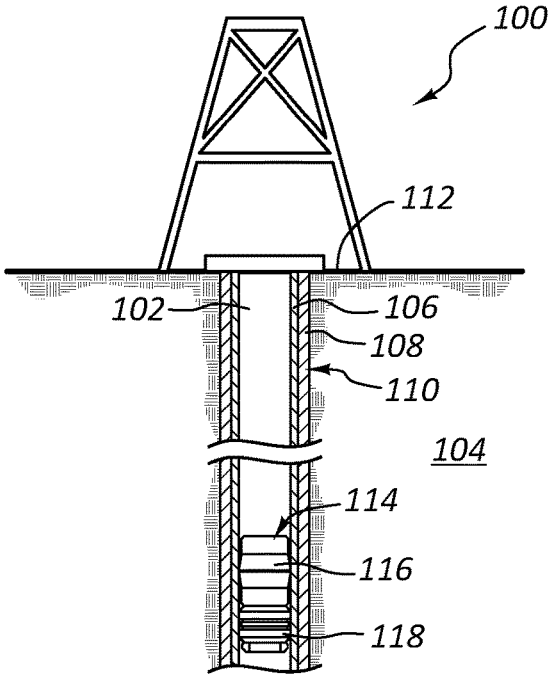
FIG. 1 is a schematic side view of a drilling system positioning a downhole plug in a wellbore, according to some embodiments of the present disclosure.

Referring to FIG. 1, in some embodiments, a drilling system 100 may be used to drill a wellbore 102 in a formation 104. The wellbore 102 may have one or more segments of casing 106 positioned therein to line the wellbore 102. The casing 106 may be secured relative to the wellbore 102 by cement 108 or other material in an annular space 110 between the casing 106 and the formation 104. The cement 108 or other material may bind the casing 106 to the formation 104.

The cement 108 may be delivered to the annular space 110 around the casing by pumping the cement 108 downwardly (i.e., away from the surface 112) through the wellbore and within the casing 106 and then upwardly (i.e., toward the surface 112) through around the exterior of the casing 106 and in the annular space 110 from the bottom (i.e., the portion of the wellbore farthest the surface 112) of the wellbore 102. The annular space 110 may fill with the cement 108 as the cement 108 displaces the fluid or other material in the annular space 110.

The cement 108 may then cure and harden to secure the casing 106 in the wellbore 102. To assist in delivering the cement 108 to the bottom of the casing 106, or after securing the casing 106 in the wellbore 102, a downhole tool 114 may be positioned in the casing 106. In some embodiments, the downhole tool 114 may be a downhole plug that limits or potentially prevents pressure or fluid communication between an uphole end of the downhole tool 114 and a downhole end of the downhole tool 114. In at least one embodiment, the downhole tool 114 may be a pump down displacement plug (PDDP). A PDDP may be used to pump the cement 108 to the bottom of the wellbore 102. For instance, after the cement 108 has been inserted into the wellbore 102, the PDDP may be inserted. A displacement fluid may then be positioned above the PDDP and pumped into the wellbore to move the PDDP and the cement 108 downwardly within the wellbore 102. As cement 108 reaches the bottom of the wellbore 102, the cement 108 may then flow around the casing 106 and upwardly in the annular space 110. The downhole tool 114 may include one or more seals 116 (e.g., packers, swab cups, etc.) to provide a fluid seal against the casing 106. In some embodiments, the downhole tool 114 may include one or more engagement features 118 configured to engage with the casing 106 and limit or even prevent axial and/or rotational movement of the downhole tool 114 relative to the casing 106.

Figure 2:
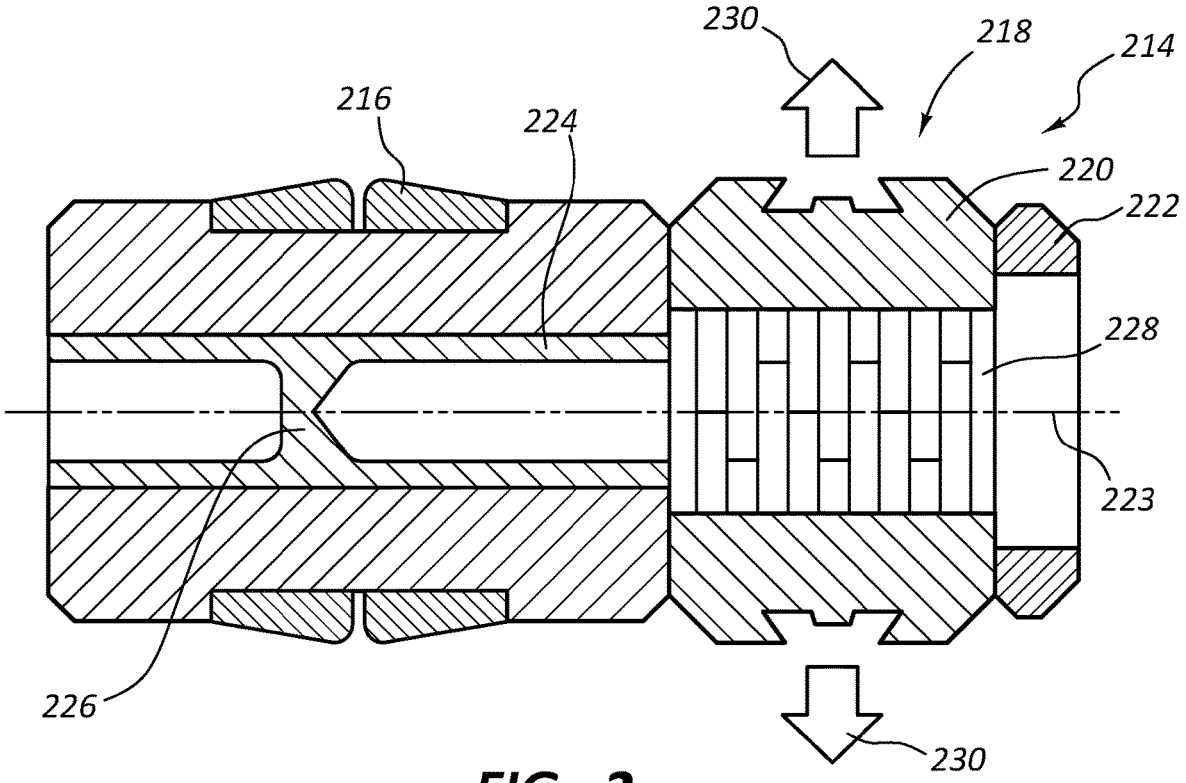
FIG. 2 is a side cross-sectional view of a downhole plug including latching dogs, according to some embodiments of the present disclosure.

FIG. 2 illustrates a downhole tool 214 according to some embodiments of the present disclosure. The downhole tool 214 may include one or more sealing elements 216 to provide a fluid seal, and one or more engagement features 218 that may engage with a casing. In some embodiments, the sealing elements 216 may include packers, swab cups, or the like. In some embodiments, the engagement features 218 of the downhole tool 214 may include one or more latching dogs 220. The one or more latching dogs 220 may be moveable in one or more directions relative to a housing 222 of the downhole tool 214. In some embodiments, the latching dogs 220 may be movable in a radial/transverse direction between a retracted position and an extended position.

When the latching dogs 220 are in the retracted position, the latching dog 220 may be fully (or largely) within the housing 222 and the downhole tool 214 may be moveable in an axial/longitudinal direction within a wellbore and/or casing (such as wellbore 102 and casing 106 shown in FIG. 1). When the latching dogs 220 are in the extended position (see FIG. 6), at least a portion of the latching dog 220 may be transversely/radially outside of the housing 222. A portion of the latching dog 222 may be considered to be radially outside the housing 222 when such portion is at a position farther from the longitudinal axis 223 than the outer surface of the housing 222. In the extended position, the portion of the latching dog 222 is radially farther from the longitudinal axis than the same portion when the latching dog 222 is in the retracted position. Moving the latching dog 222 to the extended position allows a portion of the latching dog 220 to engage with a wellbore and/or casing, in some embodiments of the present disclosure.

In some embodiments, the downhole tool 214 may have a core 224. The core 224 may be hollow, solid, or have openings therein. In some embodiments, a core 224 may have a core wall 226 that limits and/or prevents fluid communication across the downhole tool 214 in the longitudinal direction (e.g., parallel to the longitudinal axis 223). In some embodiments, the core 224 and/or core wall 226 may include or be made of a drillable material to allow removal of the downhole tool 214 by milling/drilling after placement. For example, a drillable material may include an aluminum alloy, brass, bronze, a composite material, carbon fiber, a magnesium alloy, elastomers, other drillable materials, or combinations thereof.

In some embodiments, the latching dogs 220 (or other engagement feature 218) of the downhole tool 214 may be moved between the retracted position and the extended position by a biasing element 228. For example, the biasing element 228 may include or be one or more springs, such as leaf springs, coil springs, or wishbone springs, such as shown in FIG. 2. In other examples, the biasing element 228 may include or be one or more pneumatic or hydraulic cylinders that utilize a fluid pressure differential to move the latching dogs 220. In some embodiments, the biasing element 228 may include or be made of a drillable material. In some embodiments, the biasing element 228 may apply a radially outward force 230 to move the latching dogs 220 radially/transversely toward the extended position. In at least some embodiments, movement of the latching dogs 220 in the radially outward direction may be inhibited by a wellbore or casing wall, and the latching dogs 220 may move radially outwardly when reaching a PLN or other profile in the casing or wellbore wall. In still other embodiments, the biasing element 228 may selectively apply a radially outward force 230 to move the latching dogs 220 toward the extended position, a locking mechanism may maintain the locking dogs 220 in the retracted position, the biasing member may apply a force toward the longitudinal axis 223 to move the latching dogs 220 toward the retracted position, or the biasing member may apply a longitudinally directed force to move the latching dogs 220 (e.g., biasing an axially movable piston or cam that engages and moves the latching dogs 220 radially).

Figure 3:
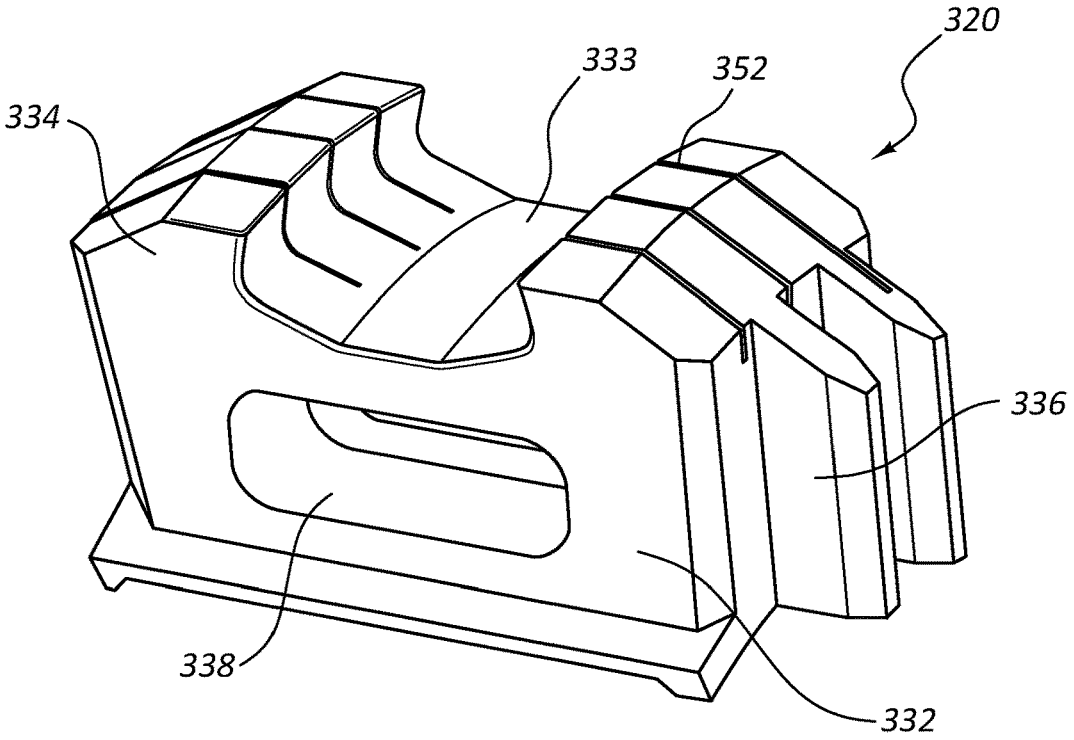
FIG. 3 is a perspective view of a latching dog, according to some embodiments of the present disclosure.

Referring to FIG. 3, a latching dog 320 according to some embodiments of present disclosure is shown. The latching dog 320 may include a dog body 332 including at least a first material. In some embodiments, the first material may be a drillable material (i.e., a material generally recognized by those skilled in the art as minimizing damage to tungsten carbide, polycrystalline diamond, or other similar cutting elements of a drill bit or mill). For example, the first material may be an aluminum alloy, such as Aluminum 6061, other 6XXX series aluminum, or other aluminum alloys. In other examples, the first material may be a composite material, carbon fiber, a polymer, or any other material that is millable/drillable by a downhole bit.

The latching dog 320 may have one or more engagement arms 334 that protrude in the transverse/radial direction (i.e., away from the longitudinal axis 223 of a downhole tool 214, such as shown in FIG. 2) from an outer radial surface 333 of the dog body 332. In some embodiments, the one or more engagement arms 334 may be integrally formed with the dog body 332. For example, the one or more engagement arms 334 may be formed of a continuous piece of first material with the dog body 332, such as a monolithic cast piece of aluminum alloy. In other examples, the dog body 332 and the one or more engagement arms 334 may be machined and/or milled from a single billet of the first material.

In other embodiments, the one or more engagement arms 334 may be formed (e.g., cast, machined, milled, etc.) separately from the dog body 332 and subsequently coupled to the dog body 332. For example, the one or more engagement arms 334 may be welded, brazed, or friction stir welded to the dog body 332. In the same or other examples, the one or more engagement arms 334 may be coupled to the dog body 332 by an adhesive. In yet additional examples, the one or more engagement arms 334 may be coupled to the dog body 332 by one or more mechanical fasteners, such as bolts, pins, clips, screws, clamps, brackets, staples, or the like. In further examples, the one or more engagement arms 334 may be coupled to the dog body 332 by one or more mechanical interlocks between the one or more engagement arms 334 and the dog body 332, such as a dovetail, snap fit, interference fit, or other mechanical interlocks of a portion of the one or more engagement arms 334 and a portion of the dog body 332. In at least one embodiment, the one or more engagement arms 334 may be coupled to the dog body 332 by a combination of one or more of the foregoing connection mechanisms.

The one or more engagement arms 334 may protrude outward in the transverse/radial direction to extend beyond an outer surface of a downhole tool in an extended position. The portion of the engagement arm 334 farthest from the dog body 332 may be an outer wear surface that contacts and potentially engages with the casing. The outermost portion of the engagement arm 334 may experience increased wear (from contact with the casing, drilling fluids, exposure to cuttings, etc.) and, in some embodiments, may include a wear-resistant coating and/or may be a wear-resistant surface. For example, the engagement arm 334 may include a WEARSOX® coating as provided by Antelope Oil Tool Company of Houston Tex., other some other coating of low friction and/or high wear resistance to increase the operational lifetime of the engagement arm 334. In other examples, the outer wear surface may be a hard coat anodized aluminum. In still other examples, rather than a wear-resistant coating, the engagement arm 334 or an outer portion thereof may be made of a wear-resistant material.

In some embodiments, the latching dog 320 may include one or more features to limit or potentially prevent movement of the latching dog 320 relative to the housing of a downhole tool in a longitudinal direction and/or a rotational direction. For example, the latching dog 320 may include one or more retention fins 336. As shown in FIG. 3, the retention fins 336 may extend or protrude from the dog body 332 in a longitudinal direction (e.g., in a downward direction about parallel to the longitudinal axis 223 of the downhole tool 214 described in relation to FIG. 2). In some embodiments, the one or more retention fins 336 may be in whole or in part integrally formed with the dog body 332. For example, the one or more retention fins 336 may be formed of a continuous piece of first material with the dog body 332, such as a monolithic cast piece of aluminum alloy. In other examples, the dog body 332 and the one or more retention fins 336 may be machined and/or milled from a single billet of the first material. In other embodiments, the one or more retention fins 336 may be formed (e.g., cast, machined, milled, etc.) separately from the dog body 332 and subsequently coupled to the dog body 332. For example, the one or more fins 336 may be coupled to the dog body 332 using any combination of welding, brazing, adhesives, mechanical fasteners, mechanical interlocks, or other connection mechanisms, include those described herein.

In some embodiments, the one or more retention fins 336 may interlock with a recess or opening in the downhole tool or other housing in which the latching dog 320 is positioned, as will be described in more detail in relation to FIG. 9. The one or more retention fins 336 may limit or even prevent rotational and/or longitudinal movement of the latching dog 320. In some embodiments, the retention fins 336 may limit movement of the latching dog 320 relative to a housing of the downhole tool to increase milling efficiency during removal of the downhole tool. Such efficiency may increase as a result of reducing vibrations in the drill string, and chatter between the bit/mill and the latching dog 320.

In some embodiments, the number of retention fins 336 may be within a range having an upper value, a lower value, or upper and lower values including any of 1, 2, 3, 4, 5, 8, 10, or more retention fins 336. For example, a latching dog 320 may have one or more retention fins 336. In other examples, a latching dog 320 may have ten or fewer retention fins 336. In yet other examples, a latching dog 320 may have between one and ten fins 336 (e.g., two, three, or five retention fins). In some embodiments, a latching dog 320 with multiple retention fins 336 (e.g., multiple parallel retention fins) may break apart or disintegrate into a higher quantity of smaller cutting pieces during milling. A higher quantity of smaller cutting pieces may be easier to flush away with drilling fluid and have a lower risk of damage to the drill bit, mill, or drill string during milling.

In some embodiments, the dog body 332 may have at least one recess therein and/or an opening 338 therethrough. The opening 338 of FIG. 3, for instance, may extend in a lateral direction (e.g., a circumferential direction) through a full or partial width of the dog body 332, and may reduce the mass of the latching dog 320, reduce the cross-sectional area of the dog body 332 that is milled during removal of the downhole tool, or reduce the total amount of material to be milled. For example, the opening 338 may, in transverse cross-section, be a percentage of the area of the dog body 332 in a range having an upper value, a lower value, or upper and lower values including any of 30%, 40%, 50%, 60%, 70%, 75%, 85%, 90%, or any values therebetween. For example, the opening 338 may be greater than 30% of a transverse cross-sectional area of the dog body 332. In other examples, the opening 338 may be less than 90% of a transverse cross-sectional area of the dog body 332. In yet other examples, the opening 338 may be in a range of 30% to 90% of a transverse cross-sectional area of the dog body 332. In further examples, the opening 338 may be in a range of 40% to 80% of a transverse cross-sectional area of the dog body 332. In yet further examples, the opening 338 may be in a range of 50% to 70% of a transverse cross-sectional area of the dog body 332.

In some embodiments, the dog body 332, the extension arms 334, or both, may have at least one slot 352 therein. The slots 352 of FIG. 3, for instance, may extend in a longitudinal direction and through a partial height of the dog body 332 or extension arms 334. The slots 352 may separate the dog body 332 or extension arms 334 into multiple parts and facilitate break-up and disintegration of the latching dog 320. The width, depth, number, and position of the slots 352 may be varied in various manners to balance latching strength of the engagement arms 334 when engaged with the casing with facilitating break-up of the latching dogs 320 during milling/drill-out.

Figure 4:
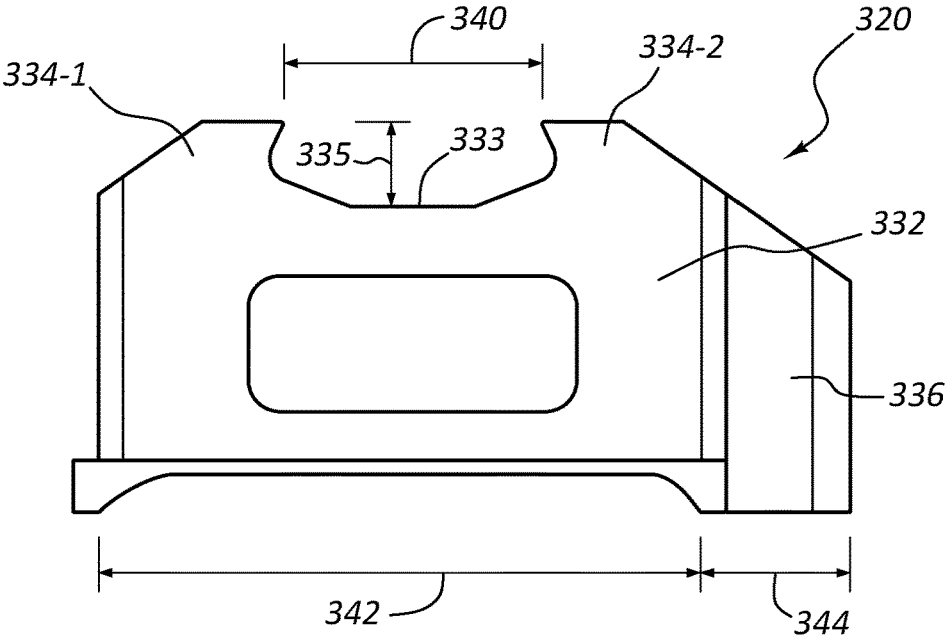
FIG. 4 is a side view the latching dog of FIG. 3, according to some embodiments of the present disclosure.

FIG. 4 illustrates the latching dog 320 of FIG. 3 in a side view. The first engagement arm 334-1 and second engagement arm 334-2 may be longitudinally spaced apart by an engagement length 340. In some embodiments, the engagement length 340 may be a percentage of a body length 342 in a range having an upper value, a lower value, or upper and lower values including any of 20%, 30%, 40%, 50%, 60%, 70%, 75%, or any values therebetween. For example, the engagement length 340 may be greater than 30% of the body length 342. In other examples, the engagement length 340 may be less than 75% of the body length 342. In yet other examples, the engagement length 340 may be in range of 20% to 75% of the body length 342. In further examples, the engagement length 340 may be in a range of 30% to 65%, 35% to 50%, or 40% to 45% of the body length 342. In at least one example, the engagement length 340 may be about 40%, about 45%, or about 50% of the body length 342.

In some embodiments, the latching dog 320 may include a first engagement arm 334-1 and a second engagement arm 334-2 that protrude an engagement height 335 from the outer radial surface 333 of the dog body 332 in the transverse/radial direction. In some embodiments, the engagement height 335 may be a percentage of the body length 342 in a range having an upper value, a lower value, or upper and lower values including any of 5%, 10%, 15%, 20%, 25%, 40%, 50%, or any values therebetween. For example, the engagement height 335 may be greater than 5% of the body length 342. In the same or other examples, the engagement height 335 may be less than 50% of the body length 342. In yet other examples, the engagement height 335 may be in range of 5% to 50% of the body length 342. In further examples, the engagement height 335 may be in a range of 5% to 30%, or 10% to 20% of the body length 342. In at least one example, the engagement height 335 may be about 10%, about 15%, about 20%, about 25%, or about 30% of the body length 342.

In some embodiments, the one or more retention fins 336 protrude in a longitudinal direction from the dog body 332. In FIGS. 3 and 4, the retention fins 336 are shown as protruding from a position proximate the second engagement arm 334-2 and in a longitudinal/axial direction away from the first engagement arm 334-1. One or more of the fins 336 may have an extension length 344. In some embodiments, the extension length 344 may be a percentage of the body length 342 in a range having an upper value, a lower value, or upper and lower values including any of 5%, 10%, 15%, 20%, 25%, 30%, 35%, 40%, 45%, 50%, or any values therebetween. For example, the extension length 344 may be greater than 5% of the body length 342. In the same or other examples, the extension length 344 may be less than 50% of the body length 342. In yet other examples, the extension length 344 may be in range of 5% to 50% of the body length 342. In further examples, the extension length 344 may be in a range of 10% to 45%, 15% to 35%, or 20% to 30% of the body length 342. In at least one example, the extension length 344 may be about 20%, about 25%, about 30%, or about 35% of the body length 342.

Figure 5:
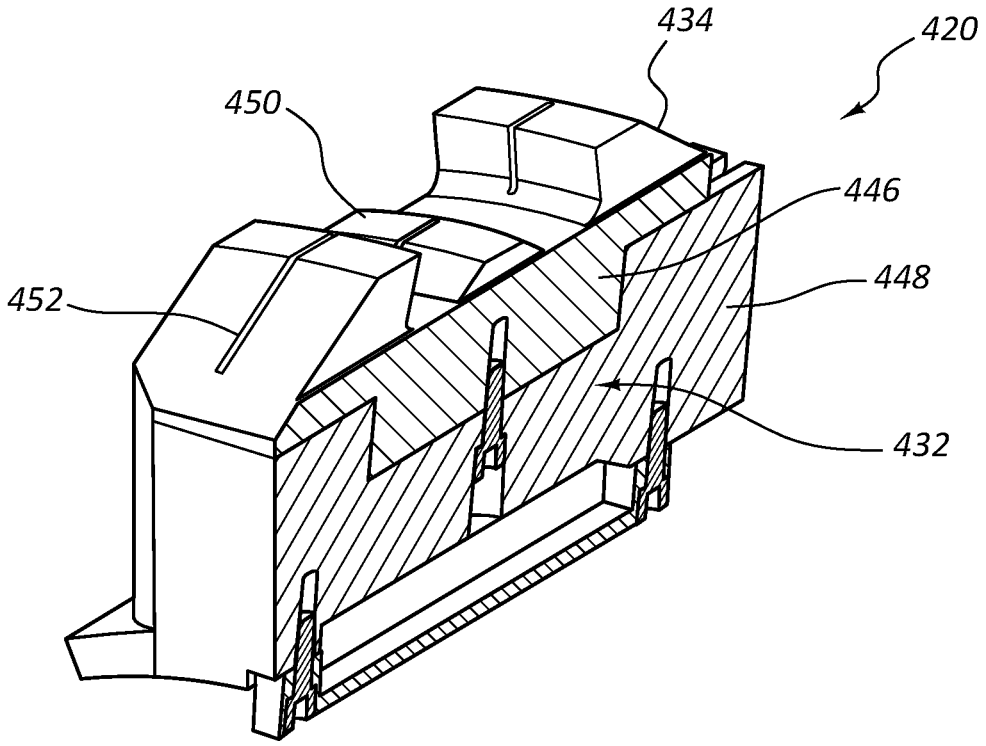
FIG. 5 is a perspective cross-sectional view of a latching dog, according to additional embodiments of the present disclosure.

FIG. 5 is a perspective view of a longitudinal cross-section a latching dog 420, according to some embodiments of the present disclosure. In some embodiments, a latching dog 420 may include a first material 446 and a second material 448. At least a portion of the dog body 432 may include the first material 446 and at least another portion of the dog body 432 may include the second material 448. In some embodiments, both the first material 446 and the second material 448 may be a drillable material. For example, the first material 446 may be an aluminum alloy, and the second material 448 may be a composite/polymer material.

As described in relation to FIG. 3 and FIG. 4, in some embodiments, the latching dog 420 may have engagement arms 434 protruding from the dog body 432 in a transverse/radial direction. As shown in FIG. 5, in some embodiments, a latching dog 420 may include one or more central protrusions 450 protruding from the outer radial surface of the dog body 432 in the transverse/radial direction, and positioned longitudinally between two engagement arms 434. In some embodiments, the central protrusion 450 may be longitudinally centered between the engagement arms 434 in the center. In other embodiments, the central protrusion 450 may be unequally spaced between the two engagement arms 434 and closer to one engagement arm 434 than the other engagement arm 434. In the same or other embodiments, the central protrusion 450 may extend radially from the outer radial surface of the dog body 432 a distance that is equal to, less than, or greater than a radial extension of the engagement arms 434. In FIG. 5, for instance, the central protrusion 450 extends radially a distance less than the radial extension of the engagement arms 434. For instance, the radial extension of the central protrusion 450 may be between 10% and 80% of the radial extension of the engagement arms 434. In more particular examples, the central protrusion 450 may extend a radial distance from the outer radial surface of the dog body 432 that is between 20% and 60%, between 25% and 50%, between 30% and 40%, or between 30% and 35% of the distance one or more of the engagement arms 434 extend from the outer radial surface of the dog body 432.

In some embodiments, one or more of the engagement arms 434 and/or central protrusion 450 may include a relief feature that may divide at least part of the engagement arm 434 and/or central protrusion 450. For example, FIG. 5 illustrates a slot 452 oriented in the longitudinal direction through both of the engagement arms 434 and the central protrusion 450. In other embodiments, the relief feature may include a series of bores (which may act like perforations, weakening the web material between the bores and approximating a slot), a score line (to increase stress risers and weaken the material along the score line), or any other feature that encourages or increases the likelihood of the material separating along the relief feature during milling of the latching dog 420.

In some embodiments, the relief feature may be oriented in the longitudinal direction, such as the slot 452 in FIG. 5. For example, the relief feature may be a longitudinal relief feature. In other embodiments, a relief feature may be oriented in other directions, such as the lateral/circumferential direction orthogonal to the longitudinal direction or a rotational direction of the downhole tool in which the latching dog 420 is used. In some embodiments, the relief feature may be hollow or otherwise empty. In other embodiments, the relief feature may be at least partially filled by second material positioned in the relief feature. In further embodiments, a slot or other relief feature may be included in the body 432 in addition to, or instead of, in the extension arms 434 and/or central protrusion 450.

Figure 6:
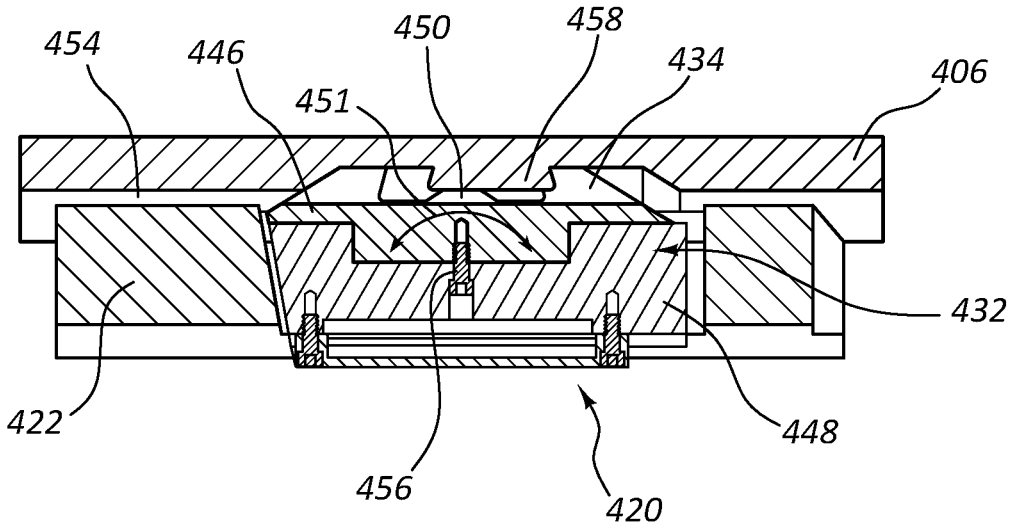
FIG. 6 is a side cross-sectional view the latching dog of FIG. 5 engaged with a casing, according to some embodiments of the present disclosure.

FIG. 6 is a side view of the longitudinal cross-section of the embodiment of a latching dog 420 in FIG. 5 coupled to and within the housing 422 of a downhole tool. FIG. 6 shows the different materials of the latching dog secured relative to one another by a mechanical fastener 456. In other embodiments, the different materials may be secured by adhesives, welding, brazing, mechanical interlocks, mechanical fasteners, or combinations thereof. In other embodiments, the latching dog 420 may be formed of a single material in a monolithic body, or by coupling multiple components.

FIG. 6 shows the longitudinal cross-section through the latching dog 420 aligned with a slot, such as slot 452 in FIG. 5. In some embodiments, a slot may extend through at least a portion of the engagement arms 434 and/or central protrusion 450 toward the dog body 432.

In some embodiments, the slot 450 may have a relief dimension through the engagement arm 434 toward the dog body 432 a percentage of the engagement height (such as the engagement height 335 described in relation to FIG. 4) that is in a range having an upper value, a lower value, or upper and lower values including any of 10%, 20%, 30%, 50%, 75%, 100%, 125%, 150%, or any values therebetween. For example, the slot 450 may have a relief dimension through the engagement arm 434 toward the dog body 432 greater than 10% of the engagement height of the engagement arm 434. In the same or other examples, the slot 450 may have a relief dimension through the engagement arm 434 toward the dog body 432 greater than 30% of the engagement height of the engagement arm 434. In yet additional examples, the slot 450 may have a relief dimension through the engagement arm 434 toward the dog body 432 greater than 50% of the engagement height of the engagement arm 434. In at least one example, the slot 450 may have a relief dimension through the entire engagement height of the engagement arm 434 (i.e., the slot extends from the outer wear surface of the engagement arm 434 to, and potentially into, the outer radial surface of the dog body 432).

FIG. 6 illustrates the latching dog 420 engaged with a portion of casing 406. At least a portion of the latching dog 420 may be positioned beyond the outer surface 454 of the housing 422 to engage with the casing 406. The casing 406 has a plug landing nipple (PLN) defining a recess 458 formed in the casing 406. The one or more engagement arms 434 may engage with the recess 458 of the PLN to limit and/or prevent the longitudinal/axial movement of the latching dog 420 (and hence the housing 422 of the downhole tool) relative to the casing 406.

The central protrusion 450 may contact a radially-inward facing surface of the recess 458 to limit or even prevent movement of the latching dog 420 and/or housing 422 relative to the casing 406. For instance, the central protrusion 450 may limit transverse/radial movement of the latching dog 420 and housing 422, or the bending of the latching dog 420 (which may cause rotation reflected by the arrow 451). The central protrusion 450 may help center the downhole tool while reducing vibration during use and/or milling, thereby increasing milling efficiency.

Figure 7:
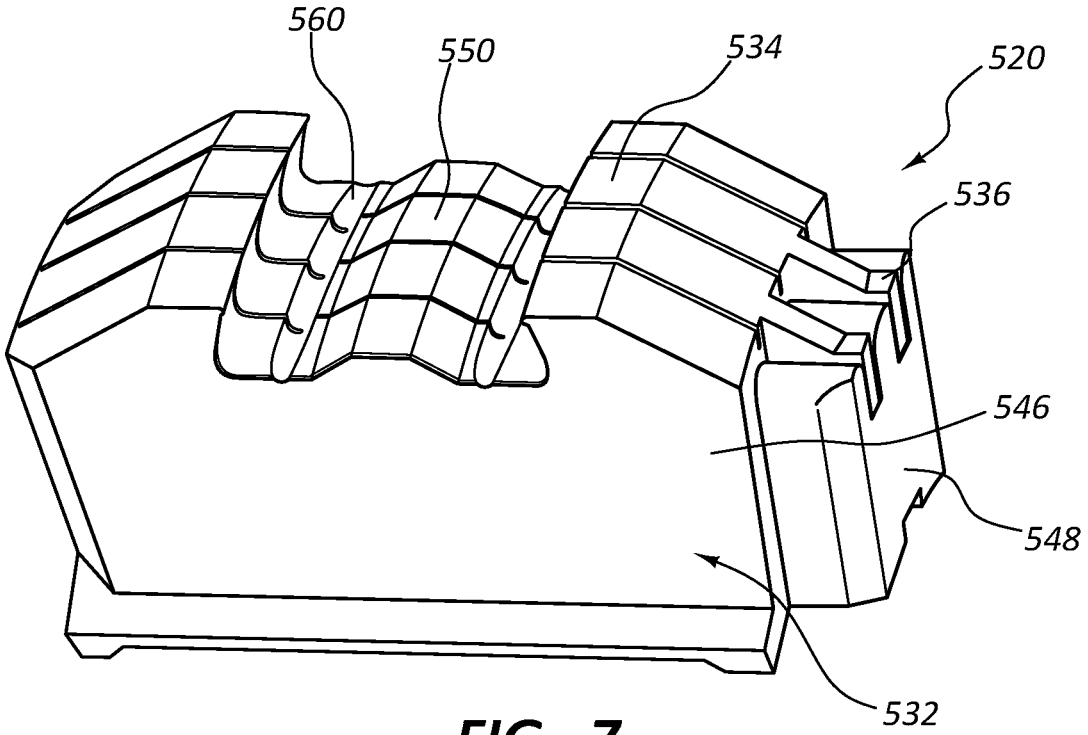
FIG. 7 is a perspective view of a latching dog, according to still further embodiments of the present disclosure.

FIG. 7 is a perspective view of yet another latching dog 520 according to some embodiments of the present disclosure. To encourage the latching dog 520 to produce smaller cuttings that are easier to flush away, the latching dog 520 may include one or more relief features, such as longitudinal slots 452 described in relation to FIG. 5 and FIG. 6. In the same or other embodiments, the dog body 532 of the latching dog 520 may include lateral grooves 560 to weaken and/or disconnect the central protrusion 550 from the engagement arms 534. In the illustrated embodiment, the lateral grooves 560 are shown as being formed on the outer radial surface of the dog body 532, and between the engagement arms 534, although such position and orientation may be modified to provide sufficient structural integrity, to promote small cuttings, or the like.

As described in relation to FIG. 5, some embodiments of a latching dog 520 may have a plurality of materials in the dog body 532. In some embodiments, the first material 546 and second material 548 are present in approximately equal proportions. In other embodiments, the dog body 532 may include more of the first material 546 or more of the second material 548, or vice versa. For example, the latching dog 520 may have an outer shell of the dog body 532 including or made of the first material 546 and an insert of the second material 548. In at least one embodiment, the second material 548 is positioned at least partially between retention fins 536 of the first material 546 to limit or even prevent movement of the first material 546 and second material 548 relative to one another, or to limit or even prevent lateral or radial deflection of the retention fins 536. For example, the second material 548 may be secured relative to the housing, and the interaction of the first material 546 and second material 548 may limit and/or prevent axial or rotational movement of the first material 546 relative to the housing.

Figure 8:
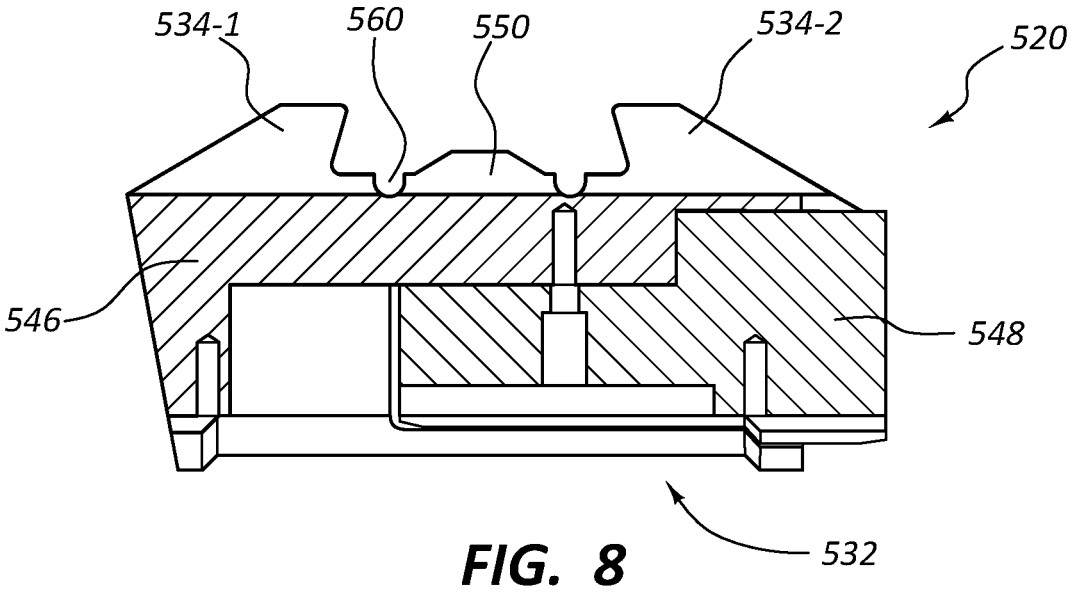
FIG. 8 is a side cross-sectional view the latching dog of FIG. 7, according to some embodiments of the present disclosure.

FIG. 8 is a longitudinal cross-section of the latching dog 520 in FIG. 7. The second material 548 may form an insert that is optionally located longitudinally within less than 100% of the longitudinal length of the dog body 532 (e.g., body length 342 in FIG. 4). In some embodiments, the second material 548 may be a percentage of the longitudinal length of the dog body 532, and the percentage may be in a range having an upper value, a lower value, or upper and lower values including any of 20%, 30%, 40%, 50%, 60%, 70%, 80%, 90%, 100%, or any values therebetween. For example, the second material 548 may extend through or along less than 100% of the longitudinal length of the dog body 532. In the same or other examples, the second material 548 may extend within or along 20% to 80% the longitudinal length of the dog body 532. In yet other examples, the second material 548 may extend through or along 25% to 80%, 30% to 70%, or 50% to 60% of the longitudinal length of the dog body 532.

The lateral grooves 560 are shown positioned longitudinally between the central protrusion 550 and the first engagement arm 534-1 and between the central protrusion 550 and the second engagement arm 534-2. In some embodiments, the latching dog 520 may have a plurality of lateral grooves 560 between the central protrusion 550 and the first engagement arm 534-1 and/or between the central protrusion 550 and the second engagement arm 534-2. In other embodiments, the latching dog 520 may have at least one lateral groove 560 positioned on an opposite side of the first engagement arm 534-1 and/or second engagement arm 534-2 from the central protrusion 550.

FIG. 8 also illustrates an angled or slanted longitudinal end of the dog body 532. In some embodiments, either or both of the longitudinal end surfaces (i.e., the longitudinal end surface proximate the retention fin(s) or the longitudinal end surface opposite the retention fin(s) and proximate the first engagement arm 534-1) of the dog body 532 may be oriented at an angle relative to the transverse/radial direction of the dog body 532. Additionally, a longitudinal end surface of at least one retention fin may be oriented at an angle to the transverse direction. For example, at least a portion of a longitudinal end surface may be planar. In other examples, at least a portion of the longitudinal end surface may be curved. In some embodiments, at least a portion of a longitudinal end surface may be oriented at an angle to the transverse direction in a range having an upper value, a lower value, or upper and lower values including any of 0°, 2.5°, 5°, 7.5°, 10°, 15°, 20°, 25°, 30°, 45°, or any values therebetween. For example, a longitudinal end may be oriented at an angle greater than 0°. In other examples, a longitudinal end may be oriented at an angle less than 45° or less than 10°. In yet other examples, a longitudinal end may be oriented at an angle in a range of 0° to 30°, 0° to 15°, or 5° to 10°.

Figure 9:
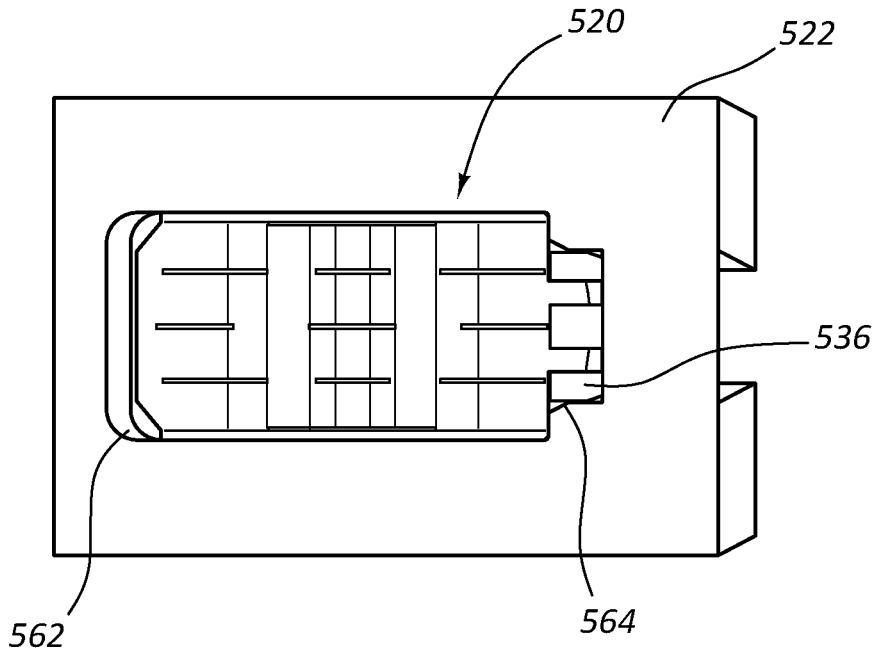
FIG. 9 is a top view of a latching dog positioned in an opening of a downhole plug, according to some embodiments of the present disclosure.

FIG. 9 is a radial view of a housing 522 of a downhole tool with the latching dog 520 of FIG. 7 and FIG. 8 positioned in an opening 562 in the housing 522. The latching dog 520 may be configured to move radially/transversely through the opening 562 between the retracted position and the extended position. In some embodiments, the opening 562 limits or even prevents longitudinal or rotational (e.g., lateral/circumferential) movement of the latching dog 520 relative to the housing 522 while the latching dog is whole or assembled. In some embodiments, a latching dog that slides or moves axially or circumferentially while milling, may reduce milling efficiency, may not break into small pieces, or may cause increased damage to a drill bit or other milling tool.

In some embodiments, the latching dog 520 may have an interference fit with the opening 562. For example, the latching dog 520 may have an interference fit with a tapered end surface 564 of the opening. In other examples, the one or more retention fins 536 of the latching dog 520 may have an interference fit with the tapered end surface 564 of the opening 562, limiting axial or rotational movement of at least part of the latching dog 520 relative to the housing 522, and enabling increased milling efficiency and cuttings transport, and decreased bit/mill damage.

Figure 10:
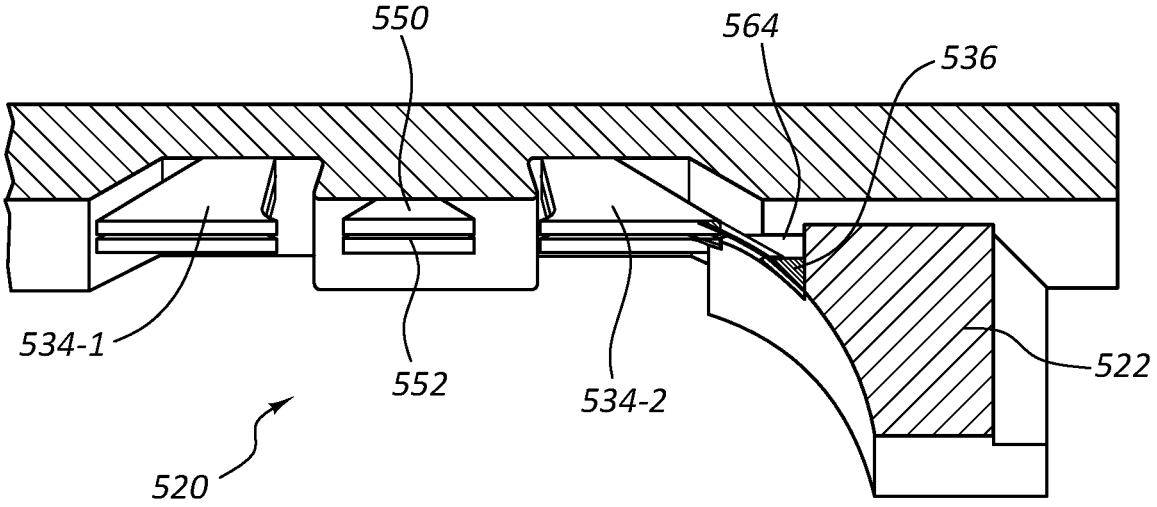
FIG. 10 is a side cross-sectional view of the downhole plug and latching dog of FIG. 9 during milling, according to some embodiments of the present disclosure.

FIG. 10 is a side perspective view of a partially milled embodiment of the latching dog 520 of FIGS. 7 to 9. The relief features (e.g., slots 552 and grooves 560) may separate remaining, un-milled pieces of the first engagement arm 534-1, the central protrusion 550, and the second engagement arm 534-2. For example, the milling process may longitudinally separate the first engagement arm 534-1, the central protrusion 550, and the second engagement arm 534-2 into different pieces, and the slots 552 may separate the first engagement arm 534-1, the central protrusion 550, and the second engagement arm 534-2 into multiple pieces of each.

A portion of the retention fin 536 is shown in FIG. 10 as illustrating the retention of at least part of the latching dog 520 engaged with the tapered end surface 564 of the housing 522, even after the uphole portion of the housing 522 is milled away. The housing 522 is progressively removed in the longitudinal direction, and the opening 562 of FIG. 9 is consequently opened up to have an increased size that could allow for additional axial or rotational movement of the latching dog 520 relative to the housing 520. The engagement of the tapered end surface 564 with the one or more retention fins 536, however, may continue to maintain at least a portion of the latching dog 520 at a fixed axial and/or rotational position relative to the remaining portion of the housing 522.

Figure 11:
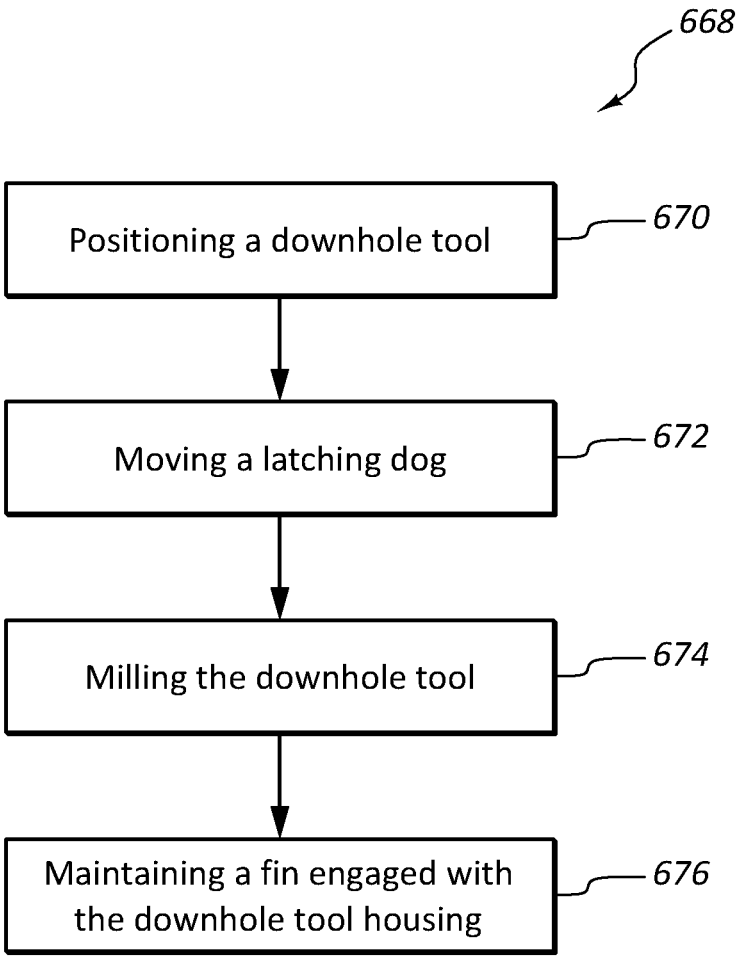
FIG. 11 is a flowchart illustrating a method of securing and removing a downhole plug, according to some embodiments of the present disclosure.

FIG. 11 is a flowchart illustrating an example method 668 of placing and removing a downhole tool. In some embodiments, the downhole tool is tripped downhole and secured relative to the casing at 670. For example, the downhole tool may be a downhole plug that is tripped through one or more casing strings (including one or more liner strings) to a predetermined location. In some embodiments, the predetermined location may be a PLN in a liner or other casing. The method 668 optionally includes moving a latching dog at 672. Moving the latching dog at 672 includes, in some embodiments, moving a latching dog according to the present description radially toward the casing to limit or even prevent movement of the downhole tool in the longitudinal direction within the casing. In some embodiments, the latching dog may move radially into a recess in a PLN. Engagement with the PLN may, in some embodiments, be without a shoulder in the PLN or casing, such that the PLN provides full bore access in the casing.

After setting the downhole tool axially/longitudinally relative to the casing (e.g., as part of a cementing process for securing the casing within a wellbore), the downhole tool may be removed by milling the downhole tool with a drill bit or mill at 674. Milling the downhole tool may include milling both a portion of the latching dog and milling at least a portion of the housing of the downhole tool. In some embodiments, at least a portion of the latching dog is not milled. For example, at least one engagement arm may be radially outside the outer diameter of the mill (and outside the internal diameter of the casing) and the engagement arm may be not milled, or may be milled after such portion collapses into the interior of the casing. The method 668 may further include maintaining at least a portion of a retaining fin of the latching dog engaged with the housing (e.g., in a tapered end of the opening) at 676. In some embodiments, the method 668 may further include flushing the cuttings from the wellbore with a drilling fluid.

In some embodiments, the latching dog and associated downhole tool may be milled out and additional downhole operations may continue. For example, the method 668 may further include drilling to a target depth after milling the downhole tool. In other examples, the method 668 may further include tripping and setting a second downhole plug after milling of the first downhole tool.

A latching dog and associated downhole tool according to the present disclosure may exhibit increased millability relative to conventional latching dogs and conventional plugs with less damage to a bit/mill, production of smaller cuttings providing easier cuttings transport, and faster milling times. More reliable, faster milling of downhole plugs may allow for more productive wellbore operations.

Embodiments of latching dogs have been primarily described with reference to wellbore drilling operations; however, the latching dogs described herein may be used in applications other than the drilling of a wellbore. In other embodiments, latching dogs according to the present disclosure may be used outside a wellbore or other downhole environment used for the exploration or production of natural resources. For instance, latching dogs of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A latching dog, comprising:

a dog body having a longitudinal axis, the dog body having an outer radial surface, the dog body including an outer shell and an insert connected to the outer shell radially inward from the outer radial surface, the outer shell being formed from a first material and the insert being formed from a second material;

at least one engagement arm protruding from the outer radial surface of the dog body in a radial direction that is transverse to the longitudinal axis; and at least one retention fin protruding from a downhole longitudinal end of the dog body, a tapered surface of the at least one retention fin being oriented transverse to the longitudinal axis, the tapered surface extending from the downhole longitudinal end of the at least one retention fin and continuing past an outer radial extent of the dog body.

2. The latching dog of claim 1, the at least one retention fin extending in a longitudinal direction from the dog body.

3. The latching dog of claim 1, the at least one engagement arm having an outer surface extending an engagement height from the outer radial surface of the dog body, and the latching dog further including one or more lateral relief features having a relief dimension in the radial direction that is at least 30% of the engagement height.

4. The latching dog of claim 1, the at least one retention fin having an extension length of at least 10% of a body length of the dog body.

5. The latching dog of claim 1, the second material including a polymer.

6. The latching dog of claim 5, the at least one retention fin including a first retention fin and a second retention fin, the insert being located between the first retention fin and the second retention fin.

7. The latching dog of claim 5, the at least one engagement arm having one or more longitudinal relief features therein, the at least one engagement arm being integral to the outer shell and including the first material and the insert being positioned in the one or more longitudinal relief features.

8. The latching dog of claim 1, an outer surface of the at least one engagement arm including a wear-resistant material different from a material of the dog body.

9. The latching dog of claim 1, the at least one engagement arm including a first engagement arm proximate a first end surface of the dog body and a second engagement arm longitudinally offset from the first engagement arm and proximate the at least one retention fin, the latching dog further comprising a protrusion located longitudinally between the first engagement arm and the second engagement arm and protruding from the dog body in the radial direction, the protrusion protruding with a protrusion height that is less than an engagement height of the first engagement arm and the second engagement arm.

10. The latching dog of claim 1, the dog body having an opening at least partially therethrough in a lateral direction orthogonal to the longitudinal axis and to the radial direction, the opening being completely enclosed by the dog body.

11. A downhole tool, comprising:

a housing with an outer surface, the outer surface of the housing defining an opening; and at least one latching dog positioned in the opening, the at least one latching dog including:

a dog body having a longitudinal axis, the dog body having an outer radial surface, at least one engagement arm protruding from the outer radial surface of the dog body in a radial direction that is transverse to the longitudinal axis, the at least one engagement arm having an outer surface extending an engagement height from the outer radial surface of the dog body, and at least one retention fin protruding from the dog body in a downhole-most position relative to the dog body, the at least one retention fin longitudinally and rotationally securing the dog body to the housing through an engagement with the opening.

12. The downhole tool of claim 11, the opening having a tapered longitudinal end surface.

13. The downhole tool of claim 12, the at least one retention fin having an interference fit with the tapered end surface of the opening.

14. The downhole tool of claim 13, the at least one retention fin extending in a longitudinal direction along the longitudinal axis and having an interference fit with the tapered end surface of the opening.

15. The downhole tool of claim 11, further comprising:

a biasing element configured to urge the at least one latching dog in the radial direction, the at least one latching dog being moveable by the biasing element from a retracted position to an extended position, at least a portion of the at least one engagement arm being radially outside the outer surface of the housing in the expanded position and the dog body being radially within the outer surface of the housing in the retracted position, the expanded position, or in both the expanded or retracted positions.

16. The downhole tool of claim 15, the biasing element including a plurality of wishbone springs.

17. A method of removing a downhole tool, comprising:

positioning a downhole tool in a wellbore casing;

moving a latching dog of the downhole tool toward an extended position and engaging the casing with at least one engagement arm of the latching dog, the latching dog having at least one retention fin engaging an opening of a housing of the downhole tool when the at least one engagement arm in is in the extended position, the opening including a tapered end surface at an outer radial surface of the housing;

milling the downhole tool; and while milling the downhole tool, maintaining an interference fit between the at least one retention fin and the opening until the inner tapered surface is milled.

18. The method of claim 17, the downhole tool being a pump down displacement plug.

19. The method of claim 17, wherein engaging the casing includes engaging a plug landing nipple of the casing.

20. The method of claim 17, wherein milling the downhole tool includes milling the latching dog and not milling at least a portion of the at least one engagement arm.

* * * * *